US011821642B2

(12) United States Patent
Adetola et al.

(10) Patent No.: US 11,821,642 B2
(45) Date of Patent: Nov. 21, 2023

(54) SUPERVISORY-LEVEL CONTROL SYSTEM DEMAND CONTROL OF AN HVAC SYSTEM

(71) Applicant: CARRIER CORPORATION, Palm Beach Gardens, FL (US)

(72) Inventors: Veronica Adetola, West Hartford, CT (US); Fu Lin, Glastonbury, CT (US); Hayden M. Reeve, West Hartford, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 62 days.

(21) Appl. No.: 17/057,190

(22) PCT Filed: Nov. 12, 2019

(86) PCT No.: PCT/US2019/060925

§ 371 (c)(1),
(2) Date: Nov. 20, 2020

(87) PCT Pub. No.: WO2020/159598

PCT Pub. Date: Aug. 6, 2020

(65) Prior Publication Data

US 2021/0348790 A1 Nov. 11, 2021

Related U.S. Application Data

(60) Provisional application No. 62/798,797, filed on Jan. 30, 2019.

(51) Int. Cl.
*F24F 11/46* (2018.01)
*F24F 11/63* (2018.01)
(Continued)

(52) U.S. Cl.
CPC ..... *F24F 11/46* (2018.01); *F24F 11/54* (2018.01); *F24F 11/63* (2018.01); *F24F 2140/60* (2018.01)

(58) Field of Classification Search
CPC .. F24F 11/46; F24F 11/54; F24F 11/63; F24F 2140/60; F24F 2140/50; F24F 11/30
See application file for complete search history.

(56) References Cited

U.S. PATENT DOCUMENTS 8,406,933 B2 3/2013 Nagel et al.
8,417,391 B1 4/2013 Rombouts et al.
(Continued)

FOREIGN PATENT DOCUMENTS

JP 2015047006 A 3/2015

OTHER PUBLICATIONS

International Search Report Application No. PCT/US2019/060925: dated Apr. 20, 2020; pp. 5.
(Continued)

*Primary Examiner* — Christopher E. Everett
*Assistant Examiner* — Christopher W. Carter
(74) *Attorney, Agent, or Firm* — CANTOR COLBURN LLP

(57) ABSTRACT

A supervisory-level control system is provided and includes a summation unit receptive of first and second signals, an HVAC system to generate the second signal according to first set-point signals and to a second set-point signal and a supervisory controller. The supervisory controller includes a control unit, a set-point scheduler and a zone level set-point distribution unit. The control unit is receptive of an error signal representing a difference between the first and second signals from the summation unit. The set-point scheduler is receptive of a demand signal generated by the control unit according to the error signal. The set-point scheduler generates a set-point command signal and the second set-point signal according to the demand signal. The zone level
(Continued)

set-point distribution unit is configured to generate the first set-point signals in accordance with the set-point command signal.

12 Claims, 4 Drawing Sheets

(51) Int. Cl.
*F24F 11/54* (2018.01)
*F24F 140/60* (2018.01)

(56) References Cited

U.S. PATENT DOCUMENTS

| | | | | |
|---|---|---|---|---|
| 8,886,363 | B2 | 11/2014 | Matthews et al. | |
| 9,002,761 | B2 | 4/2015 | Montalvo | |
| 9,031,703 | B2 | 5/2015 | Nakamura et al. | |
| 9,298,197 | B2 | 3/2016 | Matsuoka et al. | |
| 9,322,566 | B2 | 4/2016 | Wenzel et al. | |
| 9,450,408 | B2 | 9/2016 | Lu et al. | |
| 9,612,591 | B2 | 4/2017 | Sloop et al. | |
| 9,864,391 | B2 | 1/2018 | Lu et al. | |
| 9,898,787 | B2 | 2/2018 | Schindler | |
| 10,007,259 | B2 | 6/2018 | Turney et al. | |
| 10,074,980 | B2 | 9/2018 | Maeda | |
| 2011/0137468 | A1* | 6/2011 | Duncan | F24F 11/30 700/277 |
| 2013/0085614 | A1* | 4/2013 | Wenzel | G05B 13/021 700/277 |
| 2014/0148953 | A1 | 5/2014 | Nwankpa et al. | |
| 2016/0131382 | A1 | 5/2016 | Rosen | |
| 2017/0185120 | A9 | 6/2017 | Imes et al. | |
| 2018/0252428 | A1* | 9/2018 | Malcolm | F24F 11/52 |
| 2018/0372362 | A1* | 12/2018 | Turney | H02J 3/14 |

OTHER PUBLICATIONS

Kiliccote, S. et al. "Advanced Controls and Communications for Demand Response and Energy Efficient in Commercial Buildings", U.S. Department of Energy Office of Scientific and Technical Information, Jan. 17, 2006, 2 Pages.

Written Opinion Application No. PCT/US2019/060925: dated Apr. 20, 2020; pp. 8.

* cited by examiner

SUPERVISORY-LEVEL CONTROL SYSTEM DEMAND CONTROL OF AN HVAC SYSTEM

CROSS REFERENCE TO RELATED APPLICATIONS

This application claims the benefit of U.S. Application No. 62/798,797, filed on 30 Jan. 2019 which is incorporated herein by reference in its entirety.

STATEMENT OF FEDERAL SUPPORT

This invention was made with government support under contract number DE-AR0000700 awarded by the Department of Energy (DOE). The government has certain rights in the invention.

BACKGROUND

The following description relates to electrical load management and, more particularly, a supervisory-level control method that systematically manages a heating, ventilation and air-conditioning (HVAC) electrical load of a building.

Renewable energy can be generated from various sources, such as solar power, wind, heat from the interior of the planet and flowing water. Since these sources are abundant and clean, renewable energy is becoming increasingly utilized. Such utilization leads to the increasing penetration of renewable energy onto the nation's electric grid and an increased need for advanced demand-side load management.

It is often the case that imbalances exist between the available supply of electrical power and a demand for electrical power. These imbalances can arise due to multiple factors including, but not limited to, demand exceeding supply resulting from a sudden increase in electrical usage in a given location (i.e., a building). This is especially true where the available supply is partially drawn from renewable sources, which might not always be available (i.e., solar power at night or wind during a calm day).

In some cases, to the extent that utilities are incapable or unwilling to maintain standby capacity, negative effects of the imbalances between supply and demand of and for electrical power can be mitigated by demand-side load management operations being executed in commercial buildings due to their large electricity consumption and thermal mass. In practice, however, load management remains primitive despite the availability of variable frequency drives that operate HVAC equipment and building automation systems (BASs) that can monitor and control system power consumption. Indeed, many load management operations typically involve only building sub-systems being turned off during a grid event or a zone's temperature set-points being setback in ad-hoc manners.

BRIEF DESCRIPTION

According to one aspect of the disclosure, a supervisory-level control system is provided and includes a summation unit receptive of first and second signals, a heating, ventilation and air-conditioning (HVAC) system to generate the second signal according to first set-point signals and to a second set-point signal and a supervisory controller. The supervisory controller includes a control unit, a set-point scheduler and a zone level set-point distribution unit. The control unit is receptive of an error signal, which represents a difference between the first and second signals, from the summation unit. The set-point scheduler is receptive of a demand signal generated by the control unit according to the error signal. The set-point scheduler is configured to generate a set-point command signal and the second set-point signal according to the demand signal. The zone level set-point distribution unit is configured to generate the first set-point signals in accordance with the set-point command signal.

In accordance with additional or alternative embodiments, the first signal includes an input power signal and the second signal comprises a total power demand signal.

In accordance with additional or alternative embodiments, the HVAC system includes a building air distribution system and a chiller plant.

In accordance with additional or alternative embodiments, the HVAC system further includes zone climate controllers and a chiller controller.

In accordance with additional or alternative embodiments, the first set-point signals include zone temperature set-point signals receivable by the zone climate controllers and the second set-point signal includes a chilled water supply temperature (CHWST) set-point signal receivable by the chiller controller.

In accordance with additional or alternative embodiments, the zone level set-point distribution unit is configured to prioritize the zone temperature set-point signals.

In accordance with another aspect of the disclosure, a supervisory-level control method is provided and includes receiving first and second signals, generating the second signal by a heating, ventilation and air-conditioning (HVAC) system according to first set-point signals and to a second set-point signal received from a supervisory controller, determining a difference between the first signal and the second signal, generating a demand signal according to the determined difference, generating a set-point command signal and the second set-point signal according to the demand signal and generating the first set-point signals according to the set-point command signal.

In accordance with additional or alternative embodiments, the first signal includes an input power signal and the second signal includes a total power demand signal.

In accordance with another aspect of the disclosure, a system is provided and includes load entities that respectively establish a demand for electricity from a grid and include a supervisory-level control system. The supervisory-level control system includes a summation unit receptive of a first signal representative of electricity available from the grid and a second signal representative of the demand for electricity, a heating, ventilation and air-conditioning (HVAC) system to generate the second signal according to first set-point signals and to a second set-point signal and a supervisory controller. The supervisory controller includes a control unit, a set-point scheduler and a zone level set-point distribution unit. The control unit is receptive of an error signal, which represents a difference between the first and second signals, from the summation unit. The set-point scheduler is receptive of a demand signal generated by the control unit according to the error signal. The set-point scheduler is configured to generate a set-point command signal and the second set-point signal according to the demand signal. The zone level set-point distribution unit is configured to generate the first set-point signals in accordance with the set-point command signal.

In accordance with additional or alternative embodiments, at least one of a power plant and an external power source provide electricity to the electric grid.

In accordance with additional or alternative embodiments, at least one of the power plant and the external power source draw at least some electricity from renewable energy sources.

In accordance with additional or alternative embodiments, an amount of the electricity available from the electric grid to each load entity is predefined.

In accordance with additional or alternative embodiments, the first signal includes an input power signal and the second signal comprises a total power demand signal.

In accordance with additional or alternative embodiments, the HVAC system includes a building air distribution system and a chiller plant.

In accordance with additional or alternative embodiments, the HVAC system further includes zone climate controllers and a chiller controller.

In accordance with additional or alternative embodiments, the first set-point signals include zone temperature set-point signals receivable by the zone climate controllers and the second set-point signal includes a chilled water supply temperature (CHWST) set-point signal receivable by the chiller controller.

In accordance with additional or alternative embodiments, the zone level set-point distribution unit is configured to prioritize the zone temperature set-point signals.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

These and other advantages and features will become more apparent from the following description taken in conjunction with the drawings.

DETAILED DESCRIPTION

As will be described below, a supervisory-level control system and method are provided to systematically manage electrical loads of an HVAC system of a building to reduce demand charges or in response to a grid event, such as load shedding. The control system and method provide for building load adjustments by a predetermined or desired amount through coordination of the HVAC and thermal zone set-points to track desired power profiles while ensuring that zone temperatures remain within relaxed bounds. The control system and method is scalable to any chiller plant configuration and/or building system, requires no models and closes the loop with available power measurements while respecting the HVAC system operational and comfort constraints.

Figure 1:
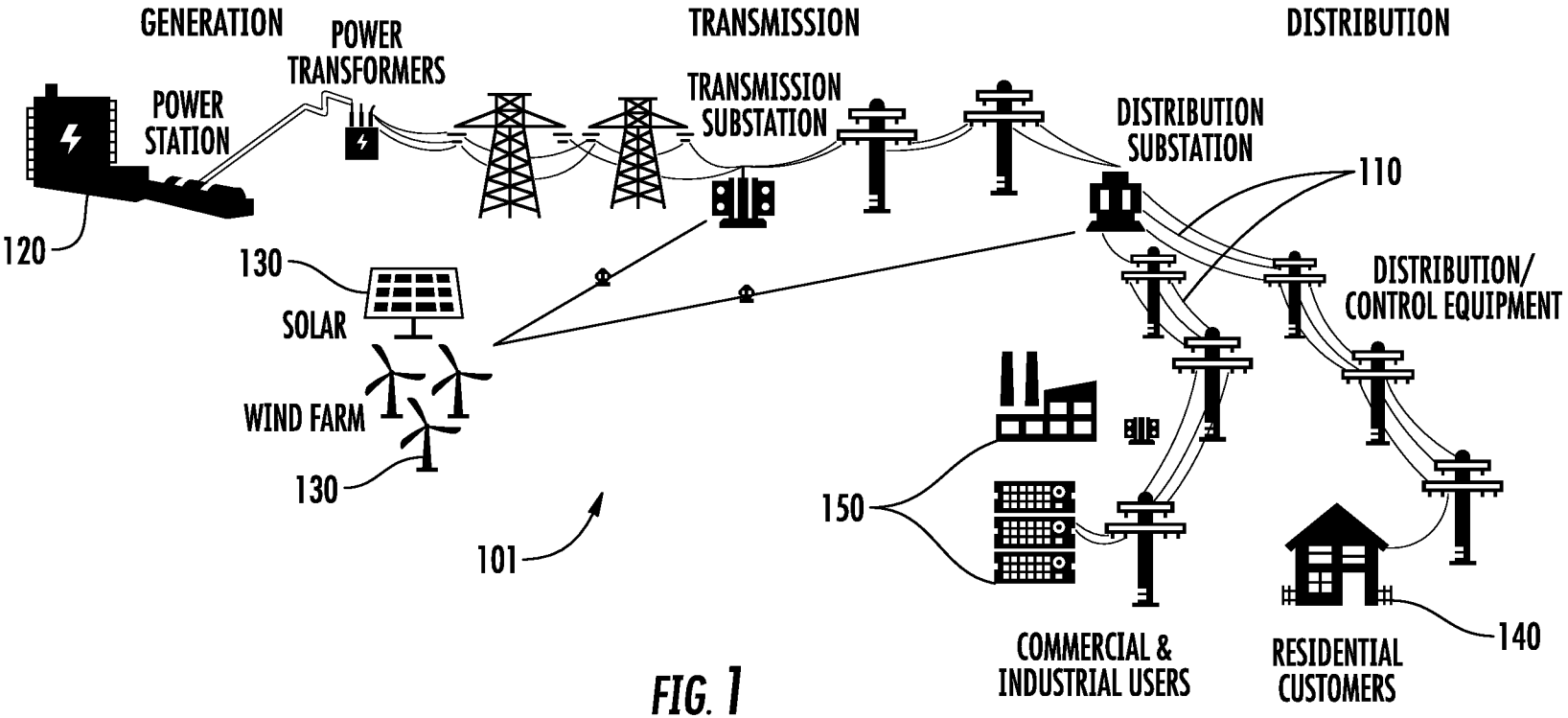
FIG. 1 is a schematic illustration of an electric grid in accordance with embodiments.

With reference to FIG. 1, an electric grid system 101 is provided. The electric grid system 101 includes an electrical grid 110, a power plant 120 that is connected to the electrical grid 110 and supplies the electrical grid 110 with electricity, an external power source 130 that is also connected to the electrical grid 110 and also supplies the electrical grid 110 with electricity, small load entities 140 and large load entities 150. The small load entities 140 can include houses and other similar small buildings and have one or more electrical devices that cooperatively make up a demand on the electrical grid 110 for each small load entity 140. The large load entities 150 can include hotels, office buildings and other similar large buildings and have one or more electrical devices that cooperatively make up a demand on the electrical grid 110 for each small load entity 140.

The power plant 120 and the external power source 130 can draw at least some of the electricity they provide to the electrical grid 110 from renewable energy sources, such as solar power, wind, heat from the interior of the planet and flowing water. As such, an available amount of electricity that is provided to the electrical grid 110 by the power plant 120 and the external power source 130 can vary over the course of hours, days, weeks, etc.

For each of the small load entities 140 and each of the large load entities 150, HVAC components, such as fans, chillers and pumps, represent significant drivers of demand. This is especially true on particularly hot and cold days when the HVAC components are operated over long periods of time in order to maintain certain comfort levels in the interiors of the small load entities 140 and the large load entities 150.

Figure 2:
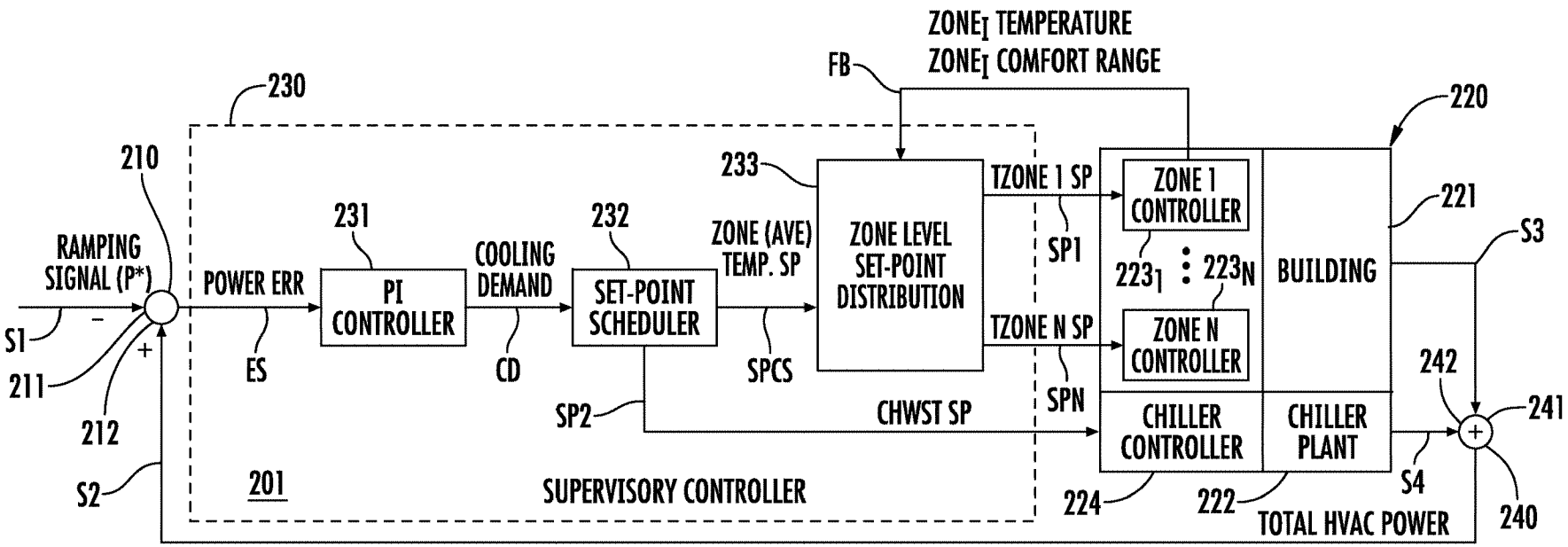
FIG. 2 is a schematic illustration of a supervisory-level control system in accordance with embodiments.
Figure 3:
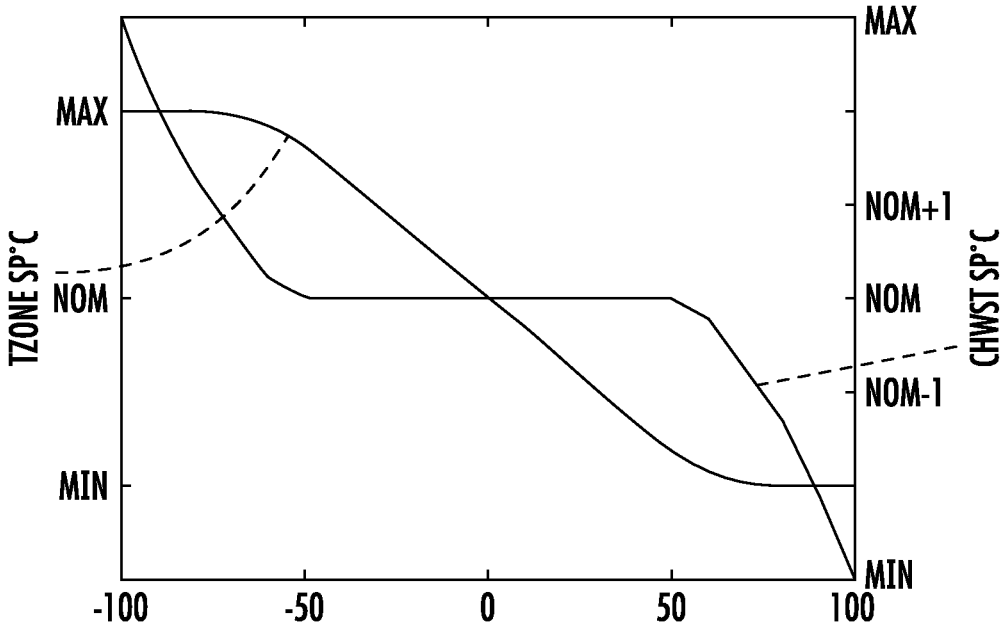
FIG. 3 is a graphical depiction of an operation of a set-point scheduler in accordance with embodiments.
Figure 4:
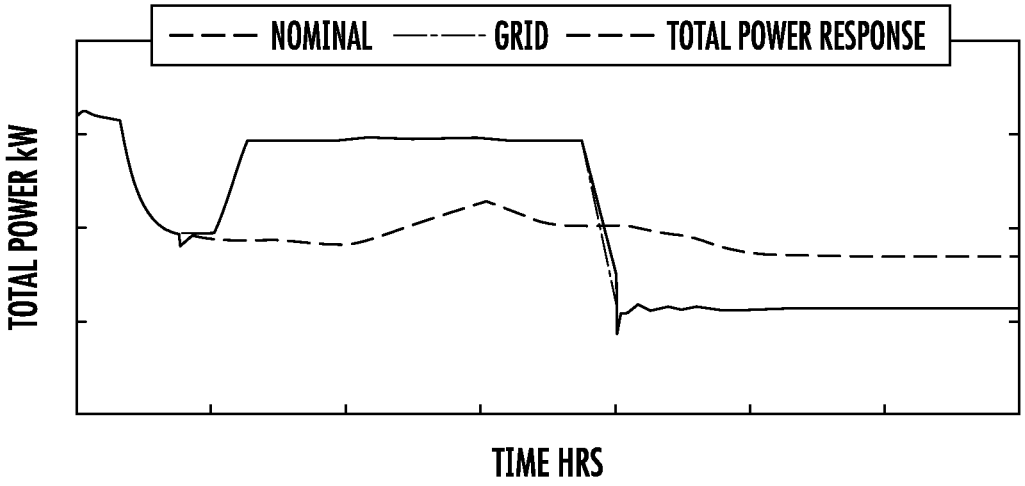
FIG. 4 is a graphical depiction of a tracking of controller performance in accordance with embodiments.

With reference to FIGS. 2-4, a supervisory-level control system 201 is provided for use with one or more of the large load entities 150 or the small load entities 140. For purposes of clarity and brevity, however, the following description will relate to the case of the supervisory-level control system 201 being provided for use in a large load entity 150, such as an office building.

As shown in FIG. 2, the supervisory-level control system 201 includes a first summation unit 210, an HVAC system 220, a supervisory controller 230 and a second summation unit 240. The summation unit 210 is receptive of an input power signal S1 from a utility, an independent system operator (ISO) or a regional transmission organization (RTO) at a first input 211 thereof and a total power demand signal S2 from the HVAC system 220 at a second input 212 thereof. The input power signal S1 can be an indication of an available amount of electricity that can be supplied to the large load entity 150 from the electric grid 110 at any given time. The input power signal S1 can be reflective of any one or more of an amount of electricity generated by the power plant 120 and the external power source 130 and/or a predefined amount of electricity that is previously agreed to by administrators of the electric grid 110 and the large load entity 150. The total power demand signal S2 is at least partially or substantially generated by the HVAC and chiller system (hereinafter referred to as the "HVAC system") 220 according to first set-point signals SP1, . . . , SPN and second set-point signal SP2. The total power demand signal S2 is reflective of the demand for electricity by the large load entity 150. Here, it is assumed for the sake of brevity and clarity that the HVAC system 220 represents a substantial driver of the total power demand for the large load entity 150 as a whole.

The supervisory controller 230 includes a control unit 231, a set-point scheduler 232 and a zone level set-point distribution unit 233. The control unit 231 can include or be provided as a proportional integral controller and is receptive of an error signal ES from the summation unit 210. The error signal ES represents a difference between the input power signal S1 and the total power demand signal S2. Being receptive of the error signal ES, the control unit 231 is configured to generate a cooling demand signal CD according to the error signal ES. The set-point scheduler 232 is receptive of the cooling demand signal CD and is configured to generate an average zone temperature set-point command signal SPCS, which is indicative of average zone temperature set-points, and the second set-point signal SP2 in order to obtain for the large load entity 150 a zone temperature and chilled water supply temperature set-point profile such as the profile illustrated in FIG. 3. The set-point command signal SPCS is received along with a feedback signal FB by the zone level set-point distribution unit 233, which accordingly generates the first set-point signals SP1, . . . , SPN. As noted above, the first set-point signals SP1, . . . , SPN and the second set-point signal SP2 are received by the HVAC system 220 whereby the HVAC system 220 operates and generates the total power demand signal S2.

In accordance with embodiments, the HVAC system 220 can include a building air distribution system 221 with building electrical energy components, such as ventilation fans, a chiller plant 222, zone climate controllers $\mathbf{223}_1, \ldots, \mathbf{223}_N$ for each climate zone in the large load entity 150 and a chiller controller 224. Each of the zone climate controllers $\mathbf{223}_1, \ldots, \mathbf{223}$N is configured to generate a respective component of the feedback signal FB, which is output to the zone level set-point distribution unit 223 and which is indicative of zone temperatures and zone comfort ranges. The building air distribution system 221 is operable in accordance with control instructions generated and output by each of the zone climate controllers $\mathbf{223}_1, \ldots, \mathbf{223}_N$ in accordance with the first set-point signals SP1, . . . , SPN being received by the zone climate controllers $\mathbf{223}_1, \ldots, \mathbf{223}_N$ as zone temperature set-point signals. The building air distribution system 221 thus generates a third signal S3, which is received at a first input 241 of the second summation unit 240. The chiller plant 222 is operable in accordance with control instructions generated and output by the chiller controller 224 in accordance with the second set-point signal SP2 being received by the chiller controller 224 as a chilled water supply temperature (CHWST) set-point signal. The chiller plant 222 thus generates a fourth signal S4, which is received at a second input 242 of the second summation unit 240. The third and fourth signals S3 and S4 are combined in the second summation unit 240 to generate the second signal S2.

In an exemplary case in which the large load entity 150 is an office building and it is a relatively hot day when there might be limited electricity available from the electric grid 110, the error signal ES will be indicative of the total power demand signal S2 exceeding the input power signal S1. This will cause the control unit 231 to generate a decreased cooling demand signal CD in order to in turn decrease the total power demand signal S2. The set-point scheduler 232 will receive the decreased cooling demand signal CD and the set-point scheduler 232 will modify the set-point command signal SPCS accordingly and will adjust the second set-point signal SP2 accordingly. The zone level set-point distribution unit 233 will be receptive of the modified set-point command signal SPCS and will adjust one or more of the first set-point signals SP1, . . . , SPN accordingly.

Where the first set-point signals SP1, . . . , SPN are indicative of average zone temperature set-points where individual zone temperature set-points are assigned based on a type of a zone, allowable temperature variations within the zone, user preferences or feedback data (all of which can be included as temperature range and comfort range data of feedback signal FB), the adjustments of the one or more first set-point signals SP1, . . . , SPN could involve raising the zone temperature set-points for one or more climate zones in the large load entity 150 by some appropriate degree so that an amount of electricity used by the HVAC system 220 (i.e., the zone climate controllers $\mathbf{223}_1, \ldots, \mathbf{223}_N$ and the building air distribution system 221) in order to comply with the raised zone temperature set-points in each climate zone is accordingly decreased on the hot day. Similarly, where the second set-point signal SP2 is indicative of an average water temperature set-point where water temperature set-points in individual water supply zones are assigned based on a type of a water supply zone, allowable water temperature variations within the water supply zone, user preferences or feedback data, the adjustment of the second set-point signal SP2 could again involve raising the CHWST set-points by some appropriate degree so that an amount of electricity used by the HVAC system 220 (i.e., the chiller controller 224 and the chiller plant 222) in order to comply with the CHWST set-points is accordingly decreased on the hot day.

As shown in FIG. 2, the large load entity 150 can have multiple climate zones (the large load entity 150 can also have multiple air handling units and/or water supply zones as well). Here, the zone level set-point distribution unit 233 can be configured to prioritize the adjustments of at least the one or more first set-point signals SP1, . . . , SPN for certain ones of the zone climate controllers $\mathbf{223}_1, \ldots, \mathbf{223}_N$. Such prioritization can be defined in accordance with a predefined zone climate schedule, preferences and feedback data.

Thus, in the exemplary case discussed above, the raising of the zone temperature set-points can be controlled such that the raised temperature set-points only affect certain areas (e.g., those multiple climate zones that are not frequented by certain customers or personnel of an office building such as public areas, restaurants, office building administration office spaces, office building staff offices and meeting rooms, etc.) without affecting other areas (e.g., those multiple climate zones that are frequented by certain customers or personnel such as offices, private meeting spaces, etc.).

As shown in FIG. 4, the supervisory-level control system 201, which is described herein, can be controlled such that the total power or the total amount of electricity demanded by the large load entity 150 closely tracks the amount of power available from the electric grid 110 even though the total power or the total amount of electricity demanded by the large load entity 150 might otherwise diverge from the nominal levels.

Figure 5:
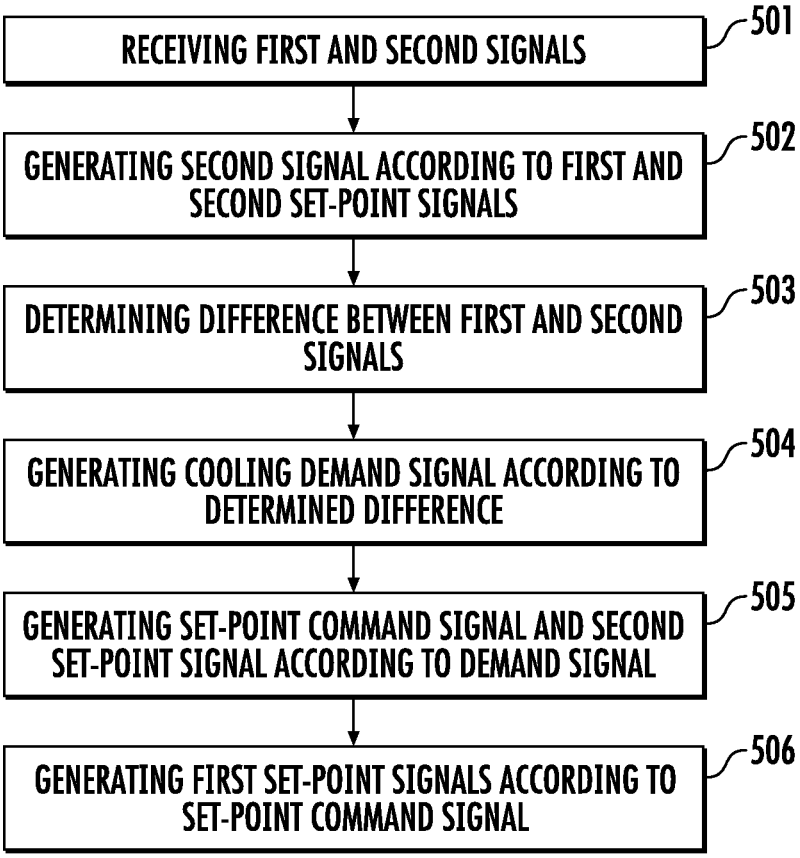
FIG. 5 is a flow diagram illustrating a supervisory-level control method in accordance with embodiments.

With reference to FIG. 5, a supervisory-level control method is provided for use in the large load entity 150 as described above. As shown in FIG. 5, the supervisory-level control method includes receiving first and second signals (501), generating the second signal by a heating, ventilation and air-conditioning (HVAC) system according to first set-point signals and to a second set-point signal received from a supervisory controller (502), determining a difference between the first signal and the second signal (503), generating a demand signal according to the determined difference (504), generating a set-point command signal and the second set-point signal according to the demand signal (505) and generating the first set-point signals according to the set-point command signal (506).

Technical effects and benefits of the features described herein are the provision of a control architecture which is scalable to non-disruptive supervisory level controls in order to enhance a building dispatch capability and to increase or decrease its electricity consumption by a certain amount within its demand flexibility limits. This will reduced electricity costs by enabling effective building responses to time of use pricing and demand charges and can be used to provide other grid services, such as ramping control.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. For example, it should be readily understood that at least the first summation unit 210, the second summation unit 240, the set-point scheduler 232 and the zone level set-point distribution unit 233 can be implemented as hardware, software and/or a combination of both, which are enabled by a computing system including a processing unit, a memory for storing executable instructions that can be read and executed by the processing unit and an input/output (I/O) unit by which the processing unit is communicative with other internal or external features. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims

What is claimed is:

1. A supervisory-level control system for use with a load entity having multiple climate zones, comprising:

first and second summation units, the first summation unit being receptive of first and second signals;

a heating, ventilation and air-conditioning (HVAC) system to generate the second signal according to first set-point signals and to a second set-point signal; and a supervisory controller comprising:

a control unit receptive of an error signal, which represents a difference between the first and second signals, from the summation unit;

a set-point scheduler receptive of a demand signal generated by the control unit according to the error signal, the set-point scheduler being configured to generate a set-point command signal and the second set-point signal according to the demand signal; and a zone level set-point distribution unit configured to generate the first set-point signals in accordance with the set-point command signal, which is received from the set-point scheduler, and a feedback signal, wherein the HVAC system comprises:

a building air distribution system comprising zone climate controllers, each zone climate controller being associated with a corresponding one of the multiple climate zones and being configured to generate a respective component of the feedback signal which is indicative of a temperature and a comfort range of the corresponding one of the multiple climate zones, the building air distribution system being operable in accordance with control instructions output by the zone climate controllers in accordance with the first set-point signals to generate a third signal;

a chiller controller, which is receptive of the second set-point signal as a chilled water set-point signal (CHWST) and which generates control instructions in accordance with the second set-point signal; and a chiller plant, which is controlled in accordance with the control instructions and which generates a fourth signal, wherein the third and fourth signals are combined by the second summation unit to generate the second signal.

2. The supervisory-level control system according to claim 1, wherein the first signal comprises an input power signal and the second signal comprises a total power demand signal.

3. The supervisory-level control system according to claim 1, wherein the first set-point signals comprise zone temperature set-point signals receivable by the zone climate controllers.

4. The supervisory-level control system according to claim 3, wherein the zone level set-point distribution unit is configured to prioritize the zone temperature set-point signals.

5. A supervisory-level control method for use with a load entity having multiple climate zones, comprising:

receiving first and second signals;

generating the second signal by a heating, ventilation and air-conditioning (HVAC) system according to first set-point signals and to a second set-point signal received from a supervisory controller;

determining a difference between the first signal and the second signal;

generating a demand signal according to the determined difference;

generating a set-point command signal and the second set-point signal according to the demand signal; and generating the first set-point signals according to the set-point command signal and a feedback signal, wherein the HVAC system comprises:

a building air distribution system comprising zone climate controllers, each zone climate controller being associated with a corresponding one of the multiple climate zones and being configured to generate a respective component of the feedback signal which is indicative of a temperature and a comfort range of the corresponding one of the multiple climate zones, the building air distribution system being operable in accordance with control instructions output by the zone climate controllers in accordance with the first set-point signals to generate a third signal;

a chiller controller, which is receptive of the second set-point signal as a chilled water set-point signal (CHWST) and which generates control instructions in accordance with the second set-point signal; and a chiller plant, which is controlled in accordance with the control instructions and which generates a fourth signal, wherein the third and fourth signals are combined to generate the second signal.

6. The supervisory-level control method according to claim 5, wherein the first signal comprises an input power signal and the second signal comprises a total power demand signal.

7. A system, comprising:

load entities having multiple climate zones that respectively establish a demand for electricity from a grid and comprise a supervisory-level control system comprising:

first and second summation units, the first summation unit being receptive of a first signal representative of electricity available from the grid and a second signal representative of the demand for electricity;

a heating, ventilation and air-conditioning (HVAC) system to generate the second signal according to first set-point signals and to a second set-point signal; and a supervisory controller comprising:

a control unit receptive of an error signal, which represents a difference between the first and second signals, from the summation unit;

a set-point scheduler receptive of a demand signal generated by the control unit according to the error signal, the set-point scheduler being configured to generate a set-point command signal and the second set-point signal according to the demand signal; and a zone level set-point distribution unit configured to generate the first set-point signals in accordance with the set-point command signal, which is received from the set-point scheduler, and a feedback signal, wherein the HVAC system comprises:

a building air distribution system comprising zone climate controllers, each zone climate controller being associated with a corresponding one of the multiple climate zones and being configured to generate a respective component of the feedback signal which is indicative of a temperature and a comfort range of the corresponding one of the multiple climate zones, the building air distribution system being operable in accordance with control instructions output by the zone climate controllers in accordance with the first set-point signals to generate a third signal;

a chiller controller, which is receptive of the second set-point signal as a chilled water set-point signal (CHWST) and which generates control instructions in accordance with the second set-point signal; and a chiller plant, which is controlled in accordance with the control instructions and which generates a fourth signal, wherein the third and fourth signals are combined by the second summation unit to generate the second signal.

8. The system according to claim 7, further comprising at least one of a power plant and an external power source to provide electricity to the grid.

9. The system according to claim 8, wherein the at least one of the power plant and the external power source draw at least some electricity from renewable energy sources.

10. The system according to claim 8, wherein an amount of the electricity available from the grid to each load entity is predefined.

11. The system according to claim 7, wherein the first signal comprises an input power signal and the second signal comprises a total power demand signal.

12. The system according to claim 7, wherein the zone level set-point distribution unit is configured to prioritize the zone temperature set-point signals.

* * * * *